US006135048A

United States Patent [19]

Emrich

[11] Patent Number: 6,135,048

[45] Date of Patent: Oct. 24, 2000

[54] FOLDABLE PONTOON

[75] Inventor: Lothar Emrich, Rehweiler, Germany

[73] Assignee: EWK Eisenwerke Kaiserslautern GmbH, Kaiserslautern, Germany

[21] Appl. No.: 09/428,040

[22] Filed: Oct. 27, 1999

[30] Foreign Application Priority Data

Nov. 6, 1998 [DE] Germany ..... 198 51 346

[51] Int. Cl.[7] ..... B63B 7/00

[52] U.S. Cl. ..... 114/353; 114/292

[58] Field of Search ..... 114/61.1, 61.15, 114/61.16, 61.17, 61.18, 61.19, 77 R, 292, 353, 283, 123

[56] References Cited

U.S. PATENT DOCUMENTS

| | | | |
|---|---|---|---|
| 831,636 | 9/1906 | Suhm | 114/61.19 |
| 2,093,320 | 9/1937 | Hunt | 114/61.19 |
| 4,172,426 | 10/1979 | Susman | 114/61.17 |

FOREIGN PATENT DOCUMENTS 3004397 7/1982 Germany .

*Primary Examiner*—Stephen Avila

*Attorney, Agent, or Firm*—Friedrich Kueffner

[57] ABSTRACT

A foldable pontoon composed of two inner floating bodies and two outer bodies which are each connected to one another by joints and can be folded together in the form of a W in the transport position. The floating bodies are connected to each other by a pull rope device composed of pull ropes and levers for facilitating the folding and unfolding procedures, wherein a two-arm unfolding lever mounted at each end face of the outer floating bodies acts with one end at a stop and a pull rope is attached to the opposite end of the unfolding lever. The joint connection between the outer floating body and the inner floating body is constructed as a double joint with a joint shaft each connected to the outer floating body and to the inner floating body. The unfolding lever is constructed as a joint plate for effecting an articulated connection of the joint shafts. The unfolding levers arranged at the end faces of the pontoon are connected to each other so as to move together.

9 Claims, 6 Drawing Sheets

FOLDABLE PONTOON

BACKGROUND OF THE INVENTION

1. Field of the Invention

The present invention relates to a foldable pontoon composed of two inner floating bodies and two outer bodies which are each connected to one another by means of joints and can be folded together in the form of a W in the transport position. The floating bodies are connected to each other by a pull rope device composed of pull ropes and levers for facilitating the folding and unfolding procedures, wherein a two-arm unfolding lever mounted at each end face of the outer floating bodies acts with one end at a stop and a pull rope is attached to the opposite end of the unfolding lever.

2. Description of the Related Art

When a pontoon of the above-described type is placed in the water and the pontoon is folded out, the two inner floating bodies are opened by the buoyancy. The two outer floating bodies are opened by a kinematic system essentially composed of pull ropes and so-called unfolding levers in dependence of the opening angles of the two inner folding bodies. When the pontoon is folded together, the outer floating bodies are moved inwardly by a push boat until they come to rest against the corresponding inner floating bodies. A crane is used for lifting the folded pontoon out of the water. The crane acts on the joint which connects the two inner floating bodies to each other at the lower longitudinal edges thereof.

In a pontoon of the above-described type disclosed in DE 30 04 397 C2, an inner floating body and an outer floating body each are connected to each other by a joint. Since these two floating bodies must move relative to each other by an angle of 180° when the pontoon is folded out, the joint components must be mounted outside of the floating bodies proper. It is unavoidable in this connection that components of the joint connection must also be arranged at the upper side of the floating bodies, so that these components protrude upwardly above the roadway in the state of use. Since not only wheeled vehicles but also tracked vehicles travel on this roadway, protruding joint components must be avoided as much as possible since otherwise damage is unavoidable.

SUMMARY OF THE INVENTION

Therefore, it is the primary object of the present invention to provide, in a pontoon of the above-described type with a pull rope device composed of pull ropes and levers for facilitating the folding and unfolding procedures, to provide a possibility for obtaining a flat roadway which also always extends over the gaps between the inner and outer floating bodies.

In accordance with the present invention, the joint connection between the outer floating body and the inner floating body is constructed as a double joint with a joint shaft each connected to the outer floating body and to the inner floating body. The unfolding lever is constructed as a joint plate for effecting an articulated connection of the joint shafts. The unfolding levers arranged at the end faces of the pontoon are connected to each other so as to move together.

For solving the problem of avoiding components protruding above the roadway plane, the present invention is based on the concept of providing a double joint connection as the connection between the inner and outer floating bodies. However, the use of a double joint is only possible when any staggered arrangement of the floating bodies can be avoided during folding and unfolding. The staggered arrangements can occur because a double joint connection is not capable of transmitting shear forces. In accordance with the present invention, this is made possible by connecting the unfolding levers at the end faces of a pontoon so as to move together. This can be effected either by means of a rotationally stiff connection extending over the entire length of the pontoon, for example, in the form of a torsion rod, or by means of a stabilizing component which is composed of an unfolding lever simultaneously serving as the joint plate, a rod fixedly connected to the unfolding lever and a stabilizing plate arranged fixed with respect to rotation at the opposite end of the rod. The stabilizing components arranged at both end faces of a pontoon produce a forced synchronous movement of the unfolding levers which facilitate the folding and unfolding procedures.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
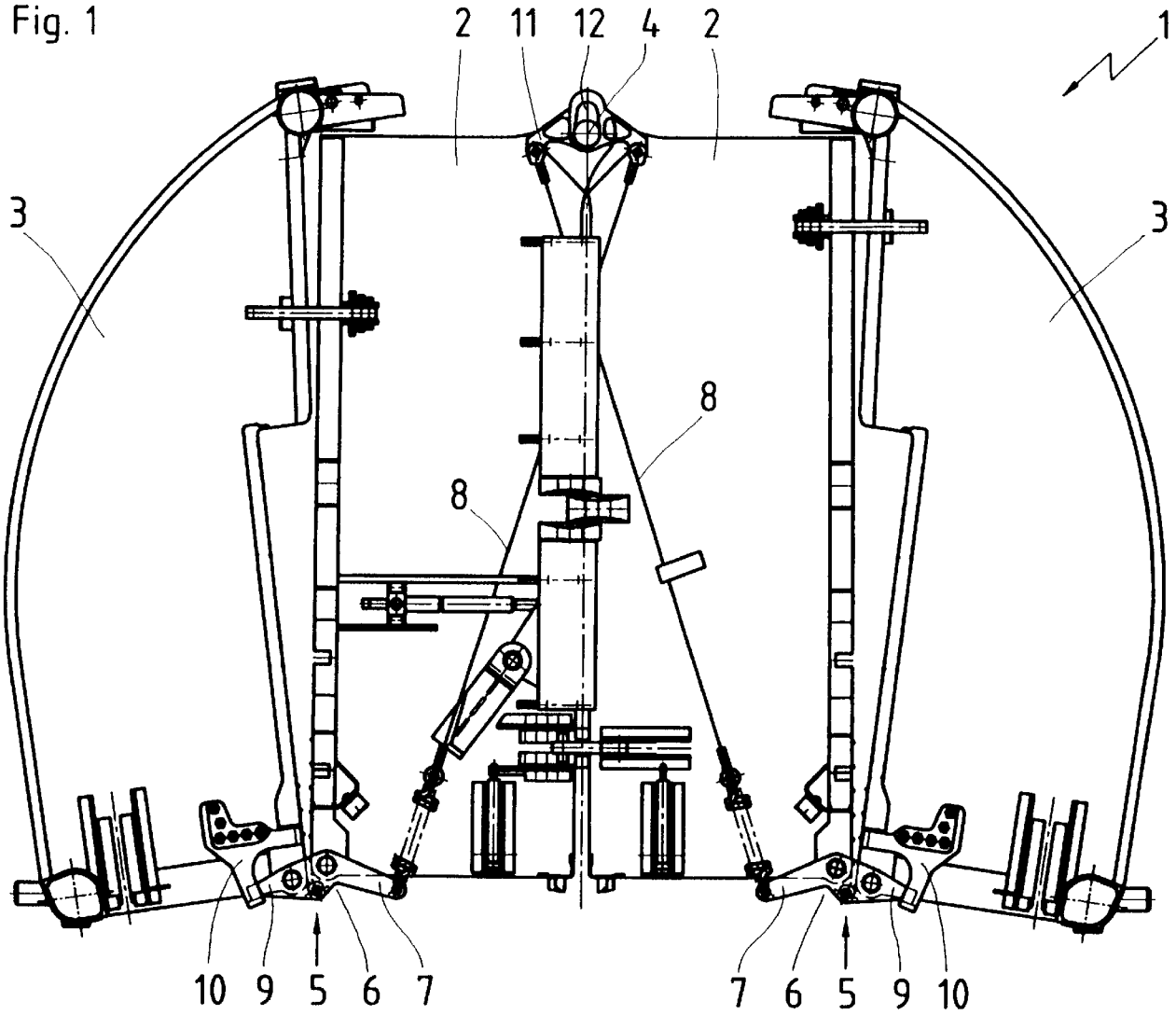
FIG. 1 is a front view of a pontoon according to the present invention shown in the folded-up transport state.

A pontoon 1 according to the present invention, shown in FIG. 1 in the folded-up state, is composed of two inner floating bodies 2 and two outer floating bodies 3. The two inner floating bodies 2 are connected to each other at a joint 4 at the bottom side thereof, and the inner floating body 2 and the outer floating body 3 on each side are connected to each other at the upper side thereof by a double joint 5. The double joint 5 includes a joint plate with an unfolding lever 6, wherein to one arm of the lever 6, the so-called rope arm 7, is attached an unfolding rope 8, while the oppositely located abutment arm 9 acts against stops of a stop component 10. The unfolding ropes 8 of the two floating body halves are attached to a double lever 11 so as to intersect; the double lever 11 is mounted so as to be rotatable about the joint 4, but otherwise is arranged in such a way that it maintains its horizontal position during all folding and unfolding procedures. The double lever 11 includes a crane eye 12.

Figure 2:
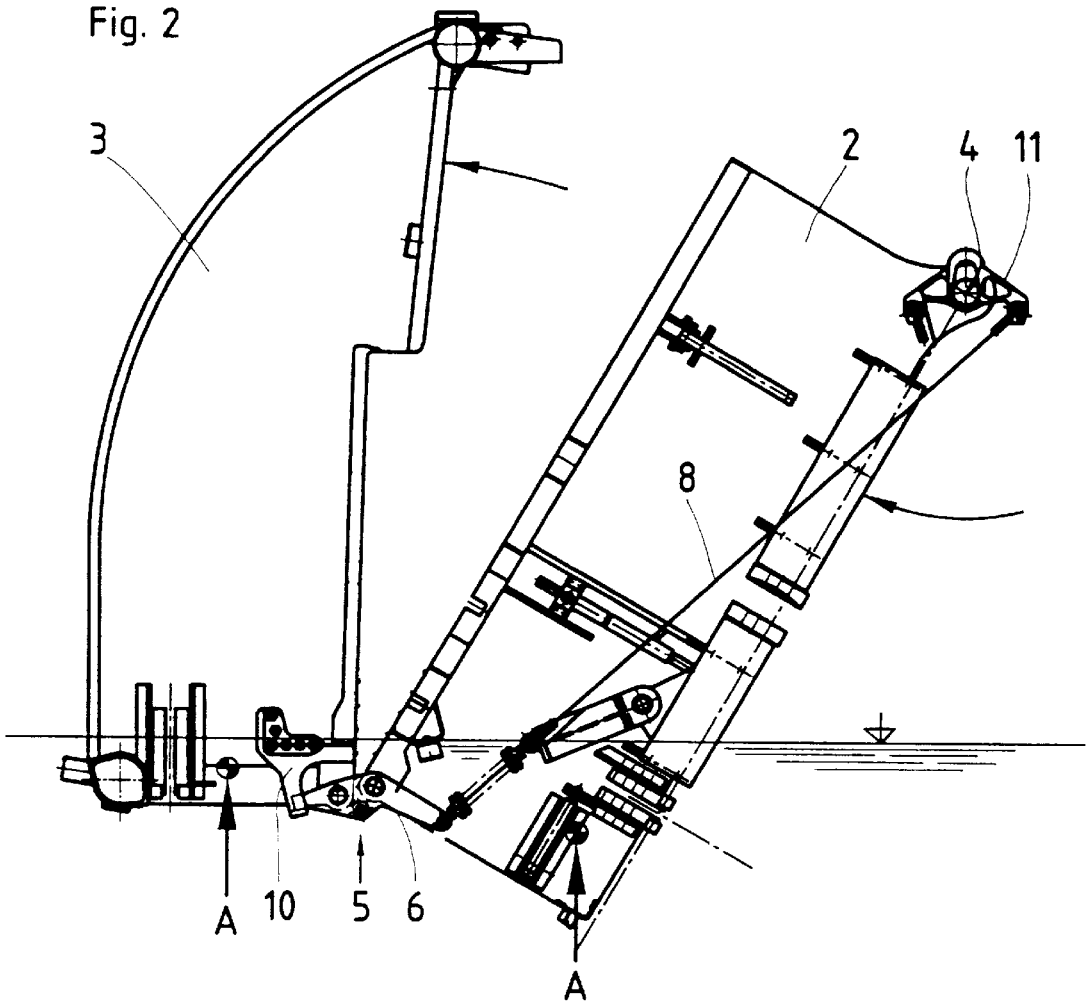
FIG. 2 is a front view of half of the pontoon composed of an outer floating body and an inner floating body showed in the state of unfolding.
Figure 3:
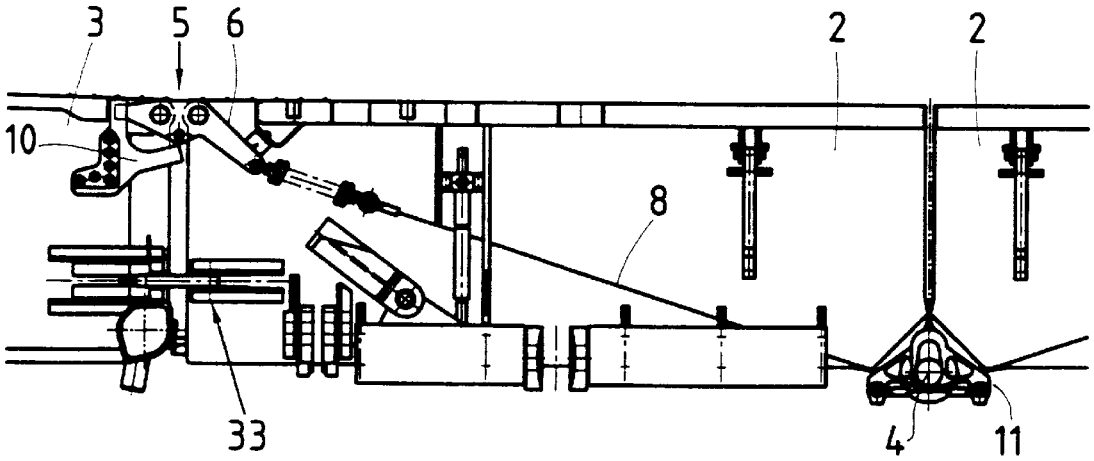
FIG. 3 is a partial front view of the pontoon shown in the state of use.
Figure 4:
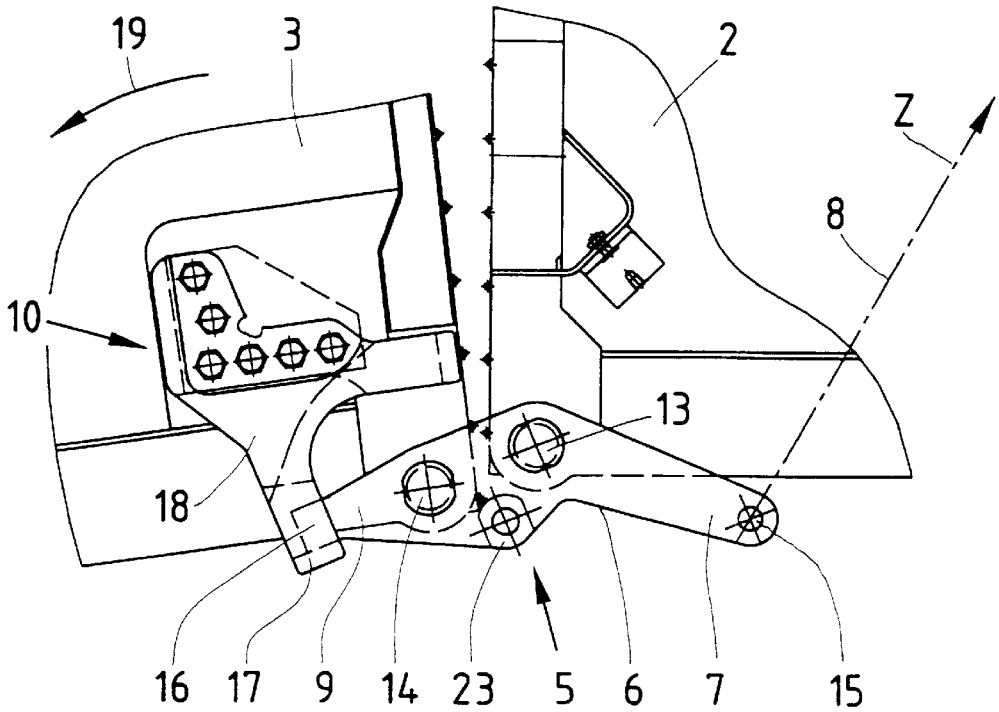
FIG. 4 is a front view, on a larger scale, of the double joint connection between the inner and outer floating bodies shown in the state of unfolding.

While FIGS. 1 to 3 show the operation of the pontoon according to the present invention, which will be described further below, the details of the pontoon according to the present invention will be explained with the aid of FIGS. 4 to 8. In this connection, FIGS. 4 and 5 show front views of the double joint connection 5 between an inner floating body 2 and an outer floating body 3, wherein FIG. 4 shows the state of unfolding and FIG. 5 shows the state of use.

The double joint connection 5 is composed of two joint shafts 13 and 14 each mounted on the inner floating body 2 and the outer floating body 3, respectively, wherein the joint shafts 13 and 14 are connected to each other in an articulated manner by means of the unfolding lever 6. Attached to the rope arm 7 of the unfolding lever 6 in a bore 15 is an unfolding rope 8, only indicated by its axis, wherein the pulling direction during unfolding is indicated by an arrow Z. The oppositely located abutment arm 9 of the unfolding lever 6 acts with its end portion 16 in different states of movement against stops which are arranged at a stop component 10 attached to the outer floating body. In the state of unfolding as shown in FIG. 4, the pulling force Z in the unfolding rope 8 produces a rotation of the unfolding lever 5 about the joint shaft 13 and, as a result of the contact of the end portion 16 of the abutment arm 9 against the stop 17 at the end of a stop arm 18, the pulling force Z produces a torque in the direction of the arrow 19 which during unfolding of the inner floating body 2 also causes an unfolding movement of the outer floating bodies 3.

Figure 5:
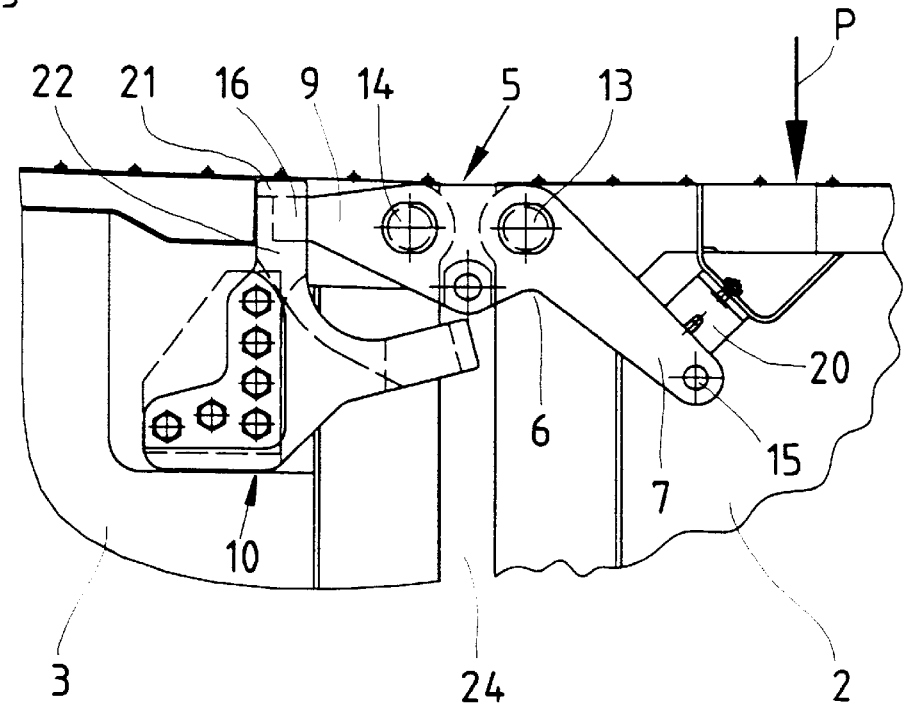
FIG. 5 is a front view of the double joint connection in the state of use.

In the state of use illustrated in FIG. 5, a traffic load in the direction of arrow P causes the inner floating bodies 2 and the outer floating bodies 3 to be pressed further down into the water. This produces a downward movement of the bolt 13, so that a torque around the bolt is generated. This torque is supported by contact of the end 16 of the abutment arm 9 against a stop 21 of another stop arm 22 of the stop component 10. As seen in FIG. 3, this torque, in turn, is supported at the inner floating body 2 through the outer floating body 3 and a locking member 33 between the inner and outer floating bodies 2 and 3. The remaining transverse force forces the outer floating body 3 downwardly. When a force acts upwardly against the bolt 13, the torque is supported between the bolt 13 and the stop 20, wherein the stop 20 may also be elastic, for example, of rubber, neoprene, or may be constructed as a metal spring element.

Figure 7:
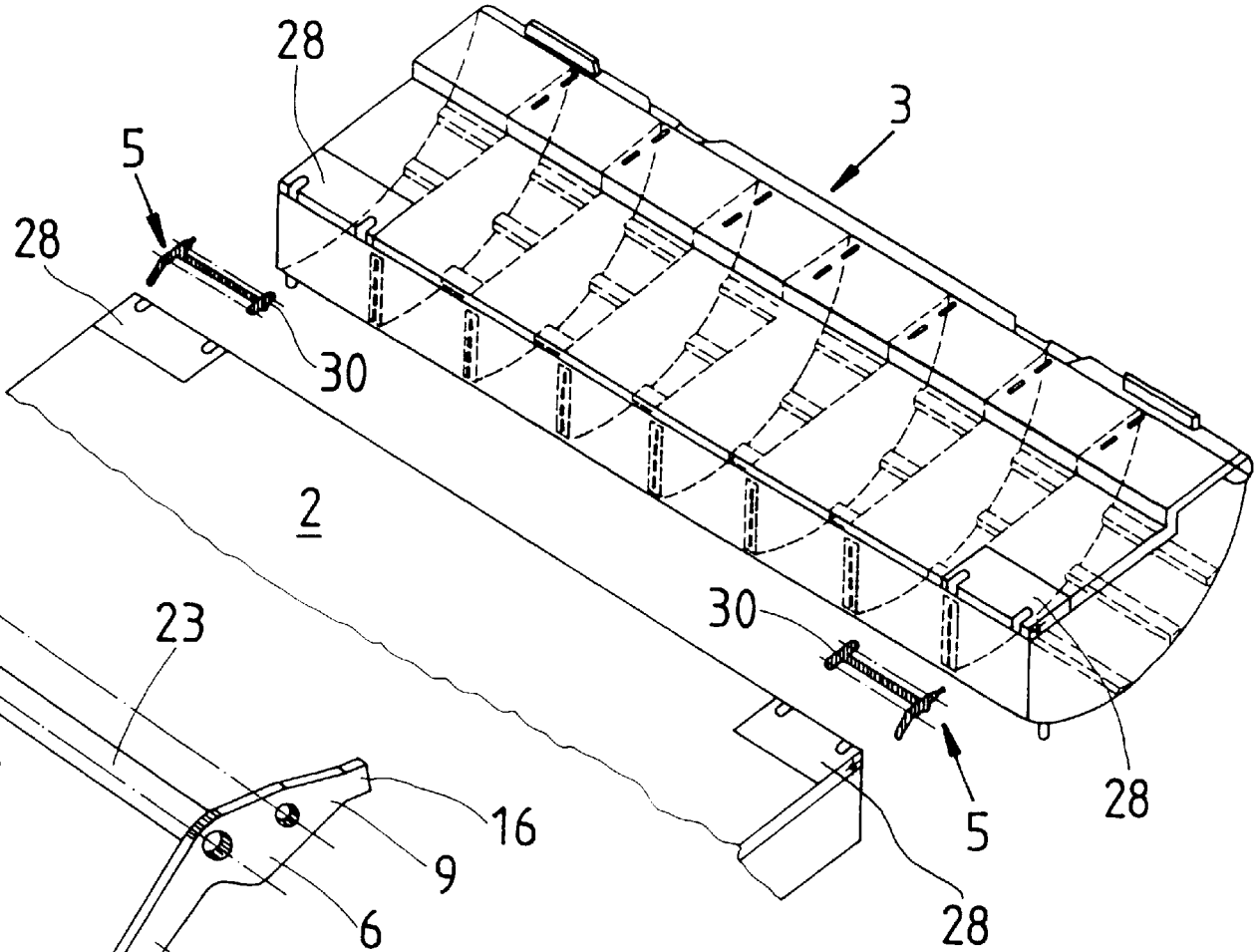
FIG. 7 is a schematic exploded restrictive view showing the operation of a stabilizing component according to the present invention.
Figure 8:
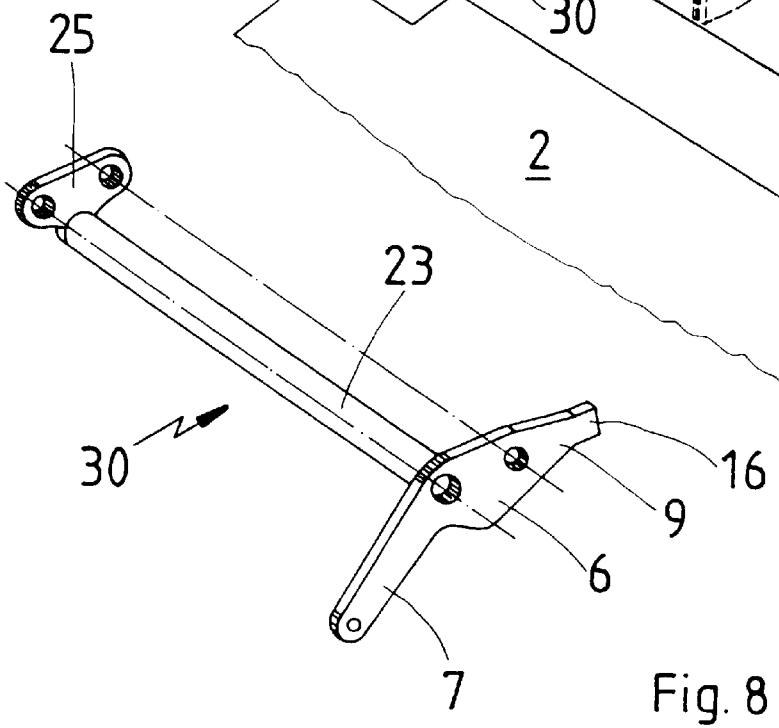
FIG. 8 is a perspective view of a stabilizing component.

It is essential for these operations that the unfolding lever 6 is part of a stabilizing component 30, as will be explained in more detail with the aid of FIGS. 6 to 8. Especially FIG. 6, which shows a portion of a top view of the pontoon in the state of use, it is illustrated how the unfolding lever 6, which connects in the form of a joint plate the two joint shafts 13 and 14, is fixedly connected to a torsion rod 23 which extends parallel to the gap 24 between the inner floating body 2 and the outer floating body 3 and is connected at its opposite end also fixedly to a stabilizing plate 25. The stabilizing plate 25 is mounted by means of two bolts 26 with axes which extend parallel to the joint shafts 13 and 14 in bearing blocks 27 which are arranged in recesses 29 in bearing parts 28 in the upper side of the inner floating body 2 and the upper side of the outer floating body 3. The unfolding lever 6, the torsion rod 23 and the stabilizing plate 25 form the stabilizing component which is denoted by reference number 30. This stabilizing component 30 is separately illustrated in FIG. 8.

Figure 6:
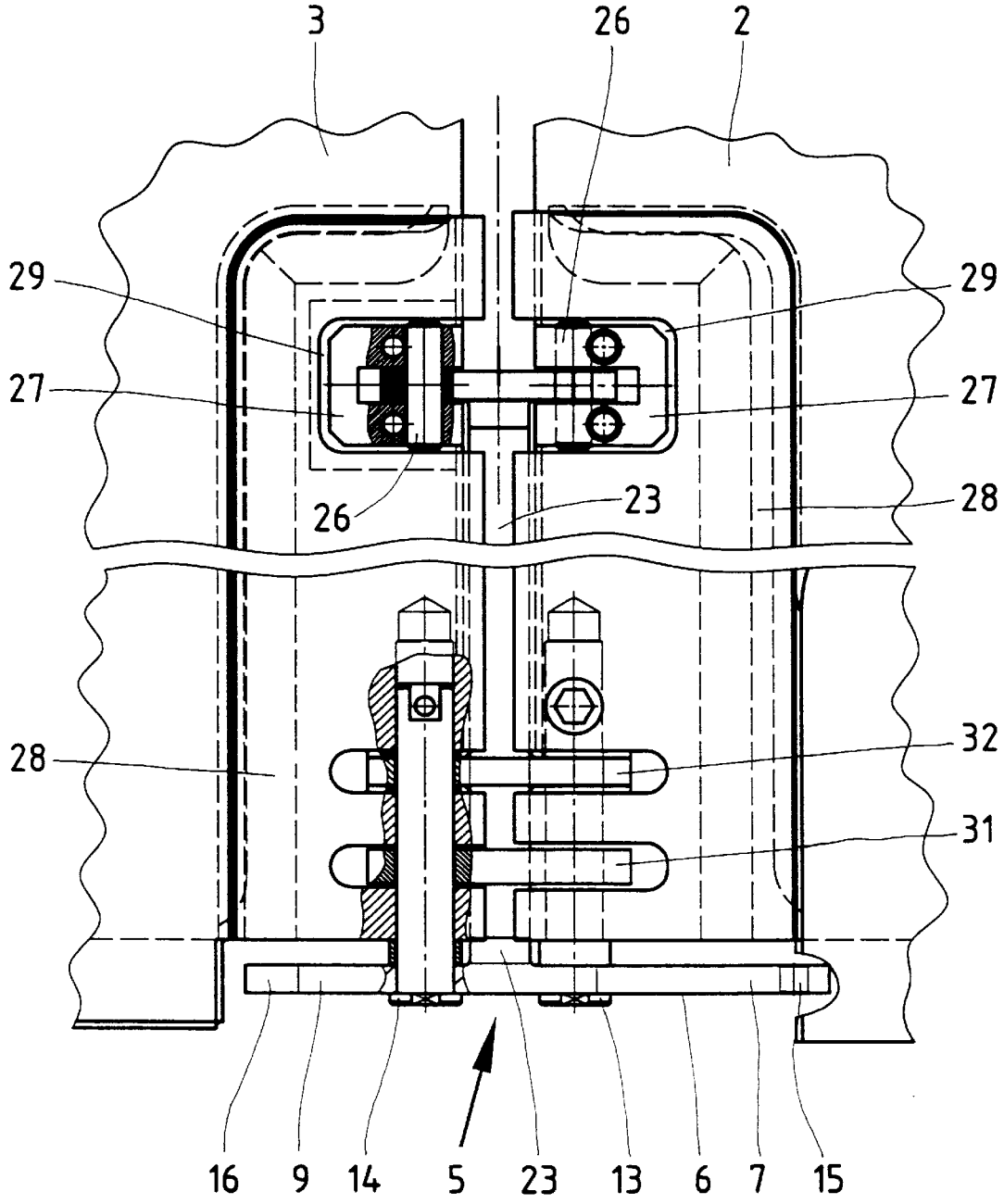
FIG. 6 is a top view of the double joint connection connecting an outer and an inner floating body shown in the state of use.

The configuration of the stabilizing component 30 illustrated in FIG. 6 is supplemented by a pull plate 31 which is mounted in the bearing parts 28 parallel to the unfolding lever 6. The pull plate 31 serves to absorb tensile forces in the roadway plane of the pontoon 1 and simultaneously serves as a bearing for the torsion rod 23. If necessary, an additional guide plate 32 can be provided parallel to the pull plate 31, wherein the guide plate 32 serves to prevent displacements in the direction of the gap 24. The arrangement of the stabilizing component 30 at the end faces of the inner floating body 2 and the outer floating body 3 is shown in FIG. 7 in an exploded view.

The operation of the pontoon according to the present invention in its individual states of movement and use, can be described as follows.

In the state of unfolding as shown in FIGS. 2 and 4, essentially only the unfolding lever 6 acts on the outer floating bodies 3 and produces the effect that the outer floating bodies 3 move away from the inner floating bodies 2 and against the buoyancy forces A. The stabilizing component 30 prevents the danger of staggering of the floating bodies 2 and 3 relative to each other; this danger must be expected when the pontoon 1 floats in the water after sliding from the transport vehicle and may carry out a swinging movement.

In the state of use shown in FIGS. 3 and 5, the unfolding lever 6 acts as a transverse force connection between the inner and outer floating bodies 2 and 3 in various load conditions.

When a traffic load acts in the direction of arrow P in FIG. 5 on the inner floating body 2, the full buoyancy force of the outer floating body 3 is transmitted to the inner floating body 2. As a result, a vertical force acts downwardly in the joint shaft 13. This vertical force produces a torque at the unfolding lever 6 which is transmitted to the outer floating body 3 through the joint shaft 14 and the stop 21. This torque and the moment from the buoyancy position of the outer floating body 2 are supported through the pull plate 31 and the floating body locking member 33 at the inner floating body 2.

In the case the inner floating body 2 is lifted in the bridge line, for example, by negative moments, the force of the weight of the outer floating body 3 is transmitted to the inner floating body 2. This causes a vertical force to act downwardly in the joint shaft 14. The resulting torque is supported by the joint shaft 13 and the contact of the rope arm 7 at the stop 20 against the inner floating body 2, as seen in FIG. 5.

Figure 9:
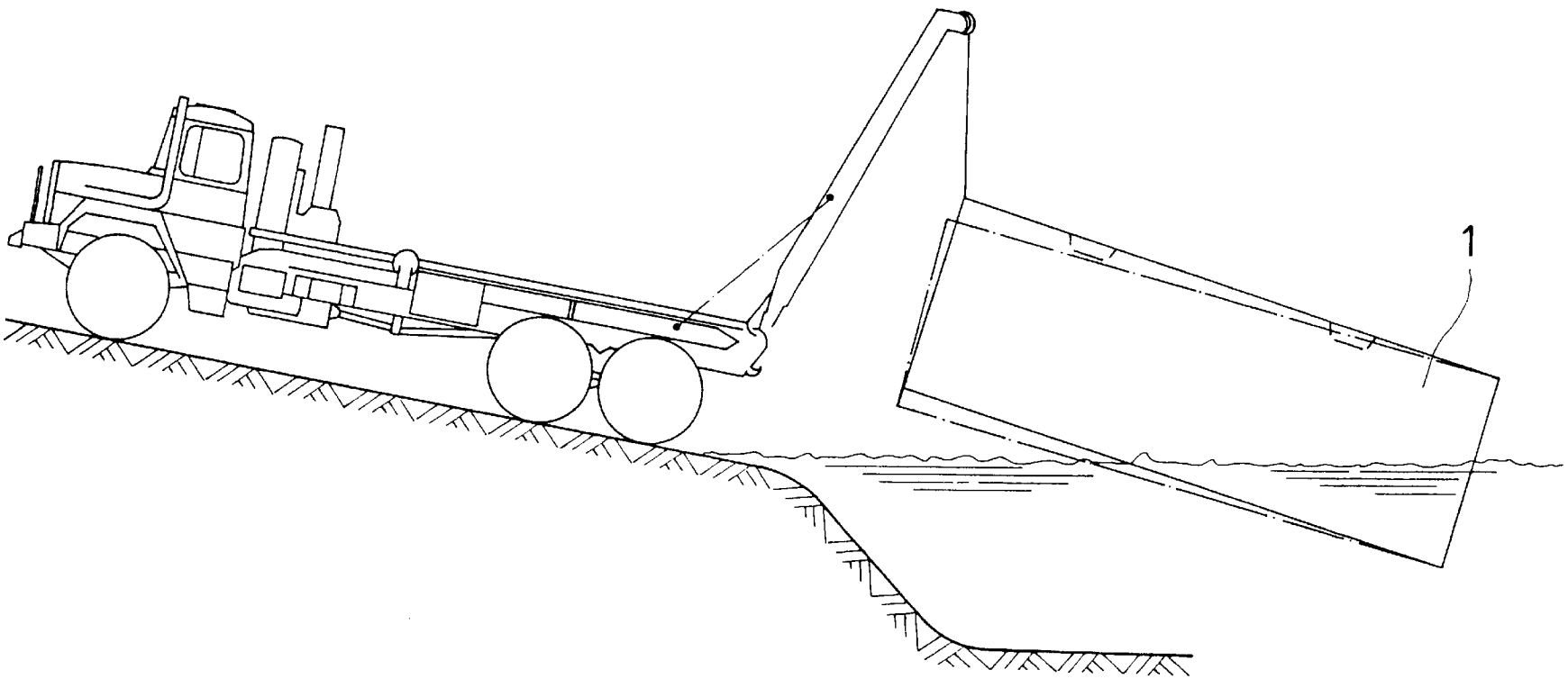
FIG. 9 is a schematic side view showing the folded pontoon being lifted out of the water.

The procedure for removing a pontoon from the water is schematically illustrated in FIG. 9. In that state, the stabilizing action is produced between the inner floating body 2 and the outer floating body 3 by the stabilizing component 30.

During the removal of the pontoon, the inner floating bodies 2 are unilaterally raised and rotated in the water. This rotation must also be transmitted to the outer floating bodies 3 in order to prevent staggering between the inner and outer floating bodies. Such a staggering of the floating bodies 2 and 3 can be prevented by the connection of the unfolding levers 6 which is stiff with respect to torsion, as proposed by the present invention. While a rotationally stiff connection of the unfolding levers 6 over the entire length of the pontoon 1 would be disadvantageous because the length of the connecting rod would require a large cross-section thereof, the present invention utilizes with the stabilizing components 30 at both sides of the pontoon 1 only portions of its total length for stabilization and, thus, also only a portion of the total staggering.

The relative rotation between the unfolding lever 6 and the stabilizing plate 25 is stabilized by a correspondingly short torsion rod 23. For this purpose, the unfolding lever 6 is fixed in bores simultaneously with the pull plate 31 or a guide plate 32, while the stabilizing plate, as already described, is supported through adjustable bearing blocks 27 at the floating bodies 2 and 3.

The invention is not limited by the embodiments described above which are presented as examples only but can be modified in various ways within the scope of protection defined by the appended patent claims.

I claim:

1. A foldable pontoon comprising two inner floating bodies and two outer floating bodies, wherein the two inner floating bodies are connected to each other through joints and the outer floating bodies are connected to the inner floating bodies through joints, and wherein the floating bodies are foldable in a transport position in the shape of a W, a pull rope device comprising pull ropes and levers for facilitating a folding and unfolding procedure of the pontoon, wherein the levers include a two-arm unfolding lever mounted at each end face of the outer floating bodies, wherein a pull rope is attached to a first end of the unfolding lever and a second end of the unfolding lever acts on a stop, wherein each joint between the outer floating body and the inner floating body is comprised of a double joint with a joint shaft mounted on the outer floating body and a joint shaft mounted on the inner floating body, wherein the unfolding lever is comprised of a joint plate for effecting an articulated connection of the joint shafts, further comprising means for connecting the unfolding levers mounted at the end faces of the pontoon such that the unfolding levers move together.

2. The pontoon according to claim 1, wherein the means for connecting the unfolding levers extends continuously over a length of the pontoon.

3. The pontoon according to claim 1, wherein each unfolding lever is fixedly connected with an end thereof to a rod extending over a portion of a length of the pontoon, wherein the rod is at its opposite end fixedly connected to a stabilizing plate, wherein the stabilizing plate is mounted in alignment with the joint shafts at the outer floating body and the inner floating body.

4. The pontoon according to claim 3, wherein the rod rotatably extends through a pull plate which over the length thereof connects the joint shafts in an articulated manner so as to be fixed with respect to tension and pressure.

5. The pontoon according to claim 4, comprising an additional joint plate arranged adjacent and parallel to the pull plate for transmitting transverse forces in a direction of joint axes.

6. The pontoon according to claim 1, wherein each unfolding lever has at an end thereof located opposite the rope arm and connected to the rope an abutment arm for interacting with the stops at the outer floating body during unfolding and in a state of use of the pontoon.

7. The pontoon according to claim 6, wherein the stops are arranged on an approximately angle-shaped stop component.

8. The pontoon according to claim 1, wherein, in a position of use of the pontoon, the rope arm of the unfolding lever is configured to interact with a stop mounted on the inner floating body.

9. The pontoon according to claim 8, wherein the stop at the inner floating body is elastically spring mounted.

* * * * *